US012607143B2

(12) United States Patent
Cha et al.

(10) Patent No.: US 12,607,143 B2
(45) Date of Patent: Apr. 21, 2026

(54) RESERVOIR TANK ASSEMBLY AND HEAT PUMP SYSTEM INCLUDING THE SAME

(71) Applicants: HYUNDAI MOTOR COMPANY, Seoul (KR); KIA CORPORATION, Seoul (KR)

(72) Inventors: Yong Woong Cha, Yongin-si (KR); Jae-Eun Jeong, Hwaseong-si (KR); Hyunjae Lee, Yongin-si (KR); Seong-Bin Jeong, Seongnam-si (KR); ChanWoong Jo, Yongin-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 106 days.

(21) Appl. No.: 18/638,181

(22) Filed: Apr. 17, 2024

(65) Prior Publication Data

US 2025/0137399 A1 May 1, 2025

(30) Foreign Application Priority Data

Oct. 31, 2023 (KR) ..... 10-2023-0147453

(51) Int. Cl.
*F01P 11/02* (2006.01)
*F01P 3/20* (2006.01)

(52) U.S. Cl.
CPC ..... *F01P 11/0285* (2013.01); *F01P 3/20* (2013.01)

(58) Field of Classification Search
CPC ..... F01P 3/20; F01P 11/029; F01P 11/028
USPC ..... 165/41
See application file for complete search history.

(56) References Cited

U.S. PATENT DOCUMENTS

| | | | | |
|---|---|---|---|---|
| 7,244,293 | B2 | 7/2007 | Morita et al. | |
| 7,631,619 | B2 | 12/2009 | Bangert et al. | |
| 8,448,696 | B2 * | 5/2013 | Johnston | B60L 58/27 165/917 |
| 10,794,265 | B2 | 10/2020 | Dumas et al. | |
| 11,035,286 | B2 * | 6/2021 | Mark | F01P 7/165 |
| 11,260,320 | B1 * | 3/2022 | Yeomans | B01D 19/0042 |
| 2008/0190385 | A1 * | 8/2008 | Bangert | F01P 11/029 123/41.44 |
| 2015/0144079 | A1 * | 5/2015 | Iafrate | B01D 19/00 96/187 |
| 2018/0266306 | A1 * | 9/2018 | Dumas | F01P 11/029 |
| 2020/0009939 | A1 * | 1/2020 | Potticary | F01P 7/165 |
| 2022/0298958 | A1 * | 9/2022 | Park | F01P 11/029 |
| 2022/0341360 | A1 * | 10/2022 | Barbolini | F01P 11/029 |

* cited by examiner

*Primary Examiner* — Steve S Tanenbaum
(74) *Attorney, Agent, or Firm* — Lempia Summerfield Katz LLC

(57) ABSTRACT

A reservoir tank assembly and a heat pump system including the same are disclosed. The reservoir tank assembly may include a reservoir tank configured to remove air contained in a coolant and an adapter fluidly connecting the reservoir tank and a coolant line along which the coolant flows. A part of the coolant flowing along the coolant line is introduced into any one degassing chamber among a plurality of degassing chambers through the adapter. The coolant passing through the plurality of degassing chambers is discharged to the coolant line through the adapter.

18 Claims, 7 Drawing Sheets

RESERVOIR TANK ASSEMBLY AND HEAT PUMP SYSTEM INCLUDING THE SAME

CROSS-REFERENCE TO RELATED APPLICATION

This application claims priority to and the benefit of Korean Patent Application No. 10-2023-0147453 filed in the Korean Intellectual Property Office on Oct. 31, 2023, the entire contents of which are incorporated herein by reference.

BACKGROUND

(a) Field of the Disclosure

The present disclosure relates to a reservoir tank assembly and a heat pump system including the same, and more particularly, to a reservoir tank assembly and a heat pump system capable of removing air contained in a coolant.

(b) Description of the Related Art

In general, an air conditioning device applied to an environmental-friendly vehicle is typically called a heat pump system.

A heat pump system for a vehicle is equipped with a reservoir tank in order to prepare for a change in volume of a coolant caused by a change in temperature of the coolant. When the coolant is heated and a volume of the coolant is expanded, the coolant with the increased volume is temporarily stored in the reservoir tank. When the coolant is cooled and a volume of the coolant decreases, the coolant stored in the reservoir tank is supplied to a cooling line.

Air is contained in the coolant when the coolant is heated and cooled. When an excessive amount of air is contained in the coolant, cooling efficiency implemented by the coolant deteriorates, and a total amount of coolant in the entire heat pump system increases. In addition, noise is caused by the air contained in the coolant while the coolant flows, and the noise adversely affects a blade of a cooling pump.

In a case where a capacity of the reservoir tank is increased to solve these problems, a volume, i.e., size of the reservoir tank is increased, which disadvantageously affects vehicle packaging.

The above information disclosed in this Background section is only to enhance understanding of the background of the disclosure. Therefore, the Background section may contain information that does not form the prior art that is already known to a person of ordinary skill in the art.

SUMMARY

The present disclosure attempts to provide a reservoir tank assembly and a heat pump system including the same, which are capable of removing air contained in a coolant.

A reservoir tank assembly according to the present disclosure may include a reservoir tank configured to remove air contained in a coolant. The assembly may also include an adapter configured to fluidly connect the reservoir tank and a coolant line along which the coolant flows. A part of the coolant flowing along the coolant line may be introduced into any one degassing chamber among a plurality of degassing chambers through the adapter. The coolant passing through the plurality of degassing chambers may be discharged to the coolant line through the adapter.

In an embodiment, the adapter may include a coolant inlet through which a part of the coolant flowing along the coolant line is introduced. The coolant inlet may be configured to communicate with any one degassing chamber among the plurality of degassing chambers. The adapter may also include a coolant outlet through which the coolant passing through the plurality of degassing chambers is discharged. The coolant outlet may be configured to communicate with another degassing chamber among the plurality of degassing chambers.

In an embodiment, the housing may include a lower casing having a plurality of lower partition walls and an upper casing provided above the lower casing and having upper partition walls corresponding to the lower partition walls. The lower partition walls and the upper partition walls may collectively define the plurality of degassing chambers to remove air contained in the coolant.

In an embodiment, degassing holes may be formed in the plurality of lower partition walls.

In an embodiment, the degassing holes may be positioned to maximize a flow distance of the coolant.

In an embodiment, the adapter may include a coolant inlet fluidly connected to a first bypass line, which branches off from the coolant line and is configured to communicate with any one degassing chamber among the plurality of degassing chambers. The adapter may also include a coolant outlet fluidly connected to a second bypass line, which branches off from the coolant line at a downstream side of the first bypass line and is configured to communicate with another degassing chamber among the plurality of degassing chambers. The coolant outlet may be configured to allow the coolant having passed through the plurality of degassing chambers to be discharged through the coolant outlet.

In an embodiment, the housing may include a lower casing having a plurality of lower partition walls and an upper casing provided above the lower casing and having upper partition walls corresponding to the lower partition walls. The lower partition walls and the upper partition walls may collectively define the plurality of degassing chambers.

In an embodiment, degassing holes may be formed in the plurality of lower partition walls.

In an embodiment, the degassing holes may be positioned to maximize a flow distance of the coolant.

A heat pump system according to an embodiment may include a coolant line along which a coolant flows, a reservoir tank configured to remove air contained in the coolant, and an adapter configured to fluidly connect the reservoir tank and the coolant line. A part of the coolant flowing along the coolant line may be introduced into any one degassing chamber among a plurality of degassing chambers through the adapter. The coolant passing through the plurality of degassing chambers may be discharged to the coolant line through the adapter.

In an embodiment, the adapter may include a coolant inlet through which a part of the coolant flowing along the coolant line is introduced into the housing. The adapter may also include a coolant outlet through which the coolant passing through the plurality of degassing chambers is discharged.

In an embodiment, the housing may include a lower casing having a plurality of lower partition walls and an upper casing provided above the lower casing and having upper partition walls corresponding to the lower partition walls. The lower partition wall and the upper partition wall may collectively define the plurality degassing chamber to remove air contained in the coolant.

In an embodiment, degassing holes may be formed in the plurality of lower partition walls.

In an embodiment, the degassing holes may be positioned to maximize a flow distance of the coolant.

In an embodiments, the heat pump system may further include a first bypass line branching off from the coolant line and a second bypass line branching off from the coolant line at a downstream side of the first bypass line. The coolant inlet of the adapter may be fluidly connected to the first bypass line and the coolant outlet of the adapter may be fluidly connected to the second bypass line.

In an embodiment, the housing may include a lower casing having a plurality of lower partition walls and an upper casing provided above the lower casing and having upper partition walls corresponding to the lower partition walls. The lower partition wall and the upper partition wall may collectively define the plurality of degassing chambers.

In an embodiment, degassing holes may be formed in the plurality of lower partition walls.

In an embodiment, the degassing holes may be positioned to maximize a flow distance of the coolant.

According to the reservoir tank assembly and the heat pump system including the same of the present disclosure as described above, the reservoir tank assembly and the coolant line are disposed in parallel, which may efficiently remove air contained in the coolant flowing along the coolant line.

Because the air contained in the coolant is removed, the cooling efficiency may be improved. Also, the capacity of the reservoir tank may be reduced, which may obtain an advantageous effect related to vehicle packaging.

Other effects, which may be obtained or expected by the embodiments of the present disclosure, are directly or implicitly disclosed in the detailed description of the present disclosure. Various effects expected according to the present disclosure are disclosed in the embodiments of the detailed description as described below.

BRIEF DESCRIPTION OF THE DRAWINGS

Because the drawings are provided for reference to describe embodiments of the present disclosure, the technical spirit of the present disclosure should not be construed as being limited to the accompanying drawings.

Figure 1:
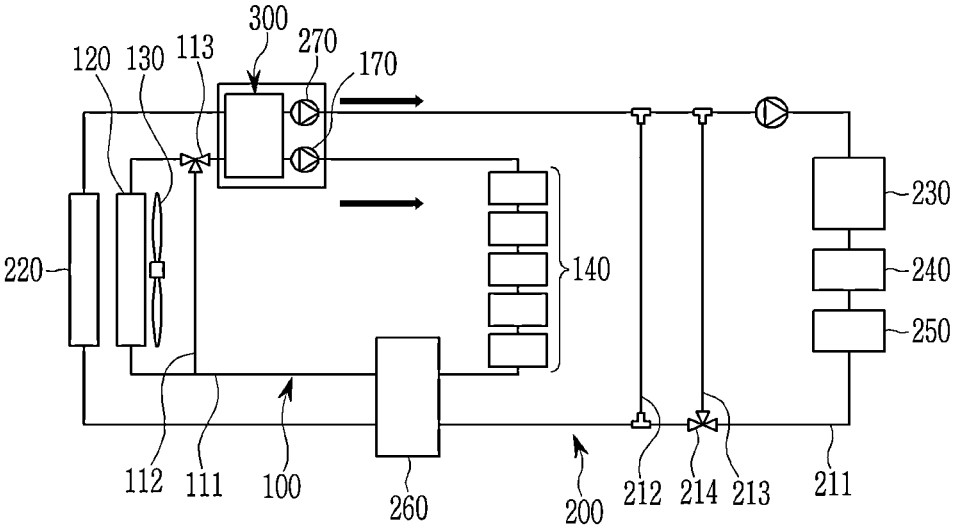
FIG. 1 is a block configuration view of a heat pump system to which a reservoir tank assembly according to the present disclosure is applied.

It should be understood that the accompanying drawings are not necessarily drawn to scale but provide a somewhat simplified representation of various features that exemplify the basic principles of the present disclosure. For example, specific design features of the present disclosure, including particular dimensions, directions, positions, and shapes, will be partially determined by the particularly intended application and use environment.

DETAILED DESCRIPTION OF THE EMBODIMENTS

The terms used herein are merely for the purpose of describing a specific embodiment and are not intended to limit the present disclosure. The singular expressions used herein are intended to include the plural expressions unless the context clearly dictates otherwise. It is to be understood that the terms "comprise (include)" and/or "comprising (including)" and variations thereof used in the present specification mean that the features, the integers, the steps, the operations, the constituent elements, and/or component are present. However, the presence or addition of one or more of other features, integers, steps, operations, constituent elements, components, and/or groups thereof is not excluded. The term "and/or" used herein includes any one or all the combinations of listed related items.

Embodiments of the present disclosure are described in detail with reference to the accompanying drawings so that those with ordinary skill in the art to which the present disclosure pertains may carry out the embodiments. However, the present disclosure may be implemented in various different ways and is not limited to the embodiments described herein.

A part irrelevant to the description may have been omitted to clearly describe the present disclosure. The same or similar constituent elements are designated by the same reference numerals throughout the specification including the drawings.

In addition, the size and thickness of each component illustrated in the drawings are arbitrarily shown for ease of description and the present disclosure is not limited thereto. In order to clearly describe several portions and regions, thicknesses thereof may have been enlarged.

The suffixes 'module', 'unit', 'part', and/or 'portion' used to describe constituent elements in the following description are used together or interchangeably in order to facilitate the description. However, the suffixes themselves do not have distinguishable meanings or functions.

In addition, in the description of the embodiments disclosed in the present specification, the specific descriptions of publicly known related technologies has been omitted where it has been determined that the specific descriptions may have obscured the subject matter of the embodiments disclosed in the present specification.

In addition, it should be interpreted that the accompanying drawings are provided only to allow those having ordinary skill in the art to understand the embodiments disclosed in the present specification. The technical spirit disclosed in the present specification is not limited by the accompanying drawings, and includes all alterations, equivalents, and alternatives that are included within the spirit and the technical scope of the present disclosure.

First, a heat pump system to which a reservoir tank assembly 300 according to the present disclosure is applied is described in detail with reference to the accompanying drawings.

As illustrated in FIG. 1, the heat pump system, to which the reservoir tank assembly 300 according to the present disclosure is applied, may include a first cooling circuit 100 configured to cool electrical components 140 and a second cooling circuit 200 configured to cool a battery. In the present disclosure, the heat pump system, which is applied to an electric vehicle, is described as an example. However, the scope of protection of the present disclosure is not limited thereto.

The first cooling circuit 100 may include a first radiator 120, the reservoir tank assembly 300, and the electrical components 140 provided in a first coolant line 111 through which a coolant flows. The first radiator 120, the reservoir tank assembly 300, and the electrical component 140 may be sequentially disposed in the first coolant line 111.

The second cooling circuit 200 may include a second radiator 220, the reservoir tank 300, a battery module 230, a battery heater 240, and a battery chiller 250 provided in a second coolant line 211 through which the coolant flows. The second radiator 220, the reservoir tank assembly 300, the battery module 230, the battery heater 240, and the battery chiller 250 may be sequentially disposed in the second coolant line 211.

The reservoir tank assembly 300 is provided to overlap the first coolant line 111 and the second coolant line 211 in this example. The coolant cooled by the first radiator 120 is stored in the reservoir tank assembly 300 through the first coolant line 111 and the coolant cooled by the second radiator 220 is stored in the reservoir tank assembly 300 through the second coolant line 211. Alternatively, a separate reservoir tank assembly 300 may be provided in the first coolant line 111 and the second coolant line 211, respectively (not shown).

A first water pump 170 is provided in the first coolant line 111 and provided at a downstream side of the reservoir tank assembly 300. A second water pump 270 is provided in the second coolant line 211 and provided at a downstream side of the reservoir tank assembly 300. The coolant stored in the reservoir tank assembly 300 is supplied to the first coolant line 111 by an operation of the first water pump 170 and supplied to the second coolant line 211 by an operation of the second water pump 270. In the present disclosure, the reservoir tank assembly 300, the first water pump 170, and the second water pump 270 may be integrated.

The first cooling circuit 100 is described more specifically below.

The first radiator 120 is disposed at a front side of the vehicle and a cooling fan 130 is provided rearward of the first radiator 120. Thus, the coolant flowing through the first coolant line 111 is cooled by an operation of the cooling fan 130 and heat exchange with outside air.

The electrical components 140 may include an electric power control device, an electric power conversion device such as an inverter or an on-board charger (OBC), a drive motor, an autonomous driving controller, and/or the like. The electric power control device, the inverter, or the autonomous driving controller may generate heat while the vehicle travels and the charger may generate heat when charging the battery. The electrical components 140 may be provided in the first coolant line 111 and cooled in a water-cooled manner.

The first cooling circuit 100 may have a first branch line 112, as necessary. The first branch line 112 may branch off from the first coolant line 111 at an upstream side of the first radiator 120 and merge with the first coolant line 111 at a downstream side of the first radiator 120. A first valve 113 may be provided at a point at which the first branch line 112 and the first coolant line 111 are merged. The first valve 113 may be implemented as a three-way valve.

The coolant flowing through the first coolant line 111 is selectively supplied to the first radiator 120 by an operation of the first valve 113. In other words, in a case where the electrical components 140 need to be cooled by the coolant cooled by the first radiator 120, the first coolant line 111 connected to the first branch line 112 is closed and the first coolant line 111 passing through the first radiator 120 is opened by the operation of the first valve 113. Thus, the coolant, which is heated by heat exchange with the electrical component 140, is cooled by the first radiator 120. On the contrary, in a case where the electrical components 140 need not be cooled by the coolant cooled by the first radiator 120, the first coolant line 111 passing through the first radiator 120 is closed and the first branch line 112 and the first coolant line 111 communicate with each other by the operation of the first valve 113. Thus, the coolant is not supplied to the first radiator 120.

The second cooling circuit 200 is described more specifically below.

The second radiator 220 is disposed forward of the first radiator 120 and cools the coolant flowing through the second coolant line 211 by operation of the cooling fan 130 and the heat exchange with outside air. The first radiator 120 and the second radiator 220 may be integrated, as necessary.

The second cooling circuit 200 may selectively supply the coolant, which is cooled by the second radiator 220, to the battery module 230.

The battery heater 240 heats the battery module 230, as necessary. The battery heater 240 may be an electric heater configured to be operated by supplied electric power. In other words, in a case where a temperature of the coolant to be supplied to the battery module 230 is lower than a target temperature, the battery heater 240 may operate to heat the coolant flowing through the second coolant circuit. Therefore, the coolant, which increases in temperature while passing through the battery heater 240, may be supplied to the battery module 230 and raise a temperature of the battery module 230.

The battery chiller 250 cools the battery module 230, as necessary. The battery chiller 250 may lower a temperature of the coolant, which is introduced through the second coolant line 211, by heat exchange with a refrigerant. The low-temperature coolant, which has exchanged heat with the refrigerant in the battery chiller 250, may be introduced into the battery module 230 and cool the battery module 230.

A second branch line 212 and a third branch line 213 may be provided in the second cooling circuit 200. The second branch line 212 branches off from the second coolant line 211 at an upstream side of the second radiator 220 and merges with the second coolant line 211 at a downstream side of the second radiator 220. The third branch line 213 branches off from the second coolant line 211 at a downstream side of the battery chiller 250 and merges with the second coolant line 211 at an upstream side of the battery module 230. A second valve 214 may be provided at a point at which the third branch line 213 and the second coolant line 211 are merged. The second valve 214 may be implemented as a three-way valve.

The coolant flowing through the second coolant line 211 is selectively supplied to the second radiator 220 by an operation of the second valve 214.

In other words, in a case where the battery module 230 needs to be cooled by the coolant cooled by the second radiator 220, the second coolant line 211 connected to the third branch line 213 is closed and the second coolant line 211 passing through the second radiator 220 is opened by the operation of the second valve 214. Thus, the coolant heated by heat exchange with the battery module 230 is cooled by the second radiator 220.

On the contrary, in a case where the battery module 230 need not be cooled by the coolant cooled by the second radiator 220, the second coolant line 211 passing through the second radiator 220 is closed and the third branch line 213 and the second coolant line 211 communicate with each other by the operation of the second valve 214. Thus, the coolant is not supplied to the second radiator 220. In this case, the second cooling circuit 200 defines two closed circuits. In other words, the second cooling circuit 200 defines one closed circuit configured to circulate through the second radiator 220, the reservoir tank assembly 300, and the second water pump 270. The second cooling circuit also defines another closed circuit configured to circulate through the battery module 230, the battery heater 240, and the battery chiller 250.

As necessary, a water-cooled heat exchanger 260 may be provided that overlaps the first coolant line 111 and the second coolant line 211. The coolant flowing through the first coolant line 111 and the coolant flowing through the second coolant line 211 may exchange heat with each other by the water-cooled heat exchanger 260.

Hereinafter, the reservoir tank assembly 300 according to the present disclosure is described in detail with reference to the accompanying drawings.

Figure 2:
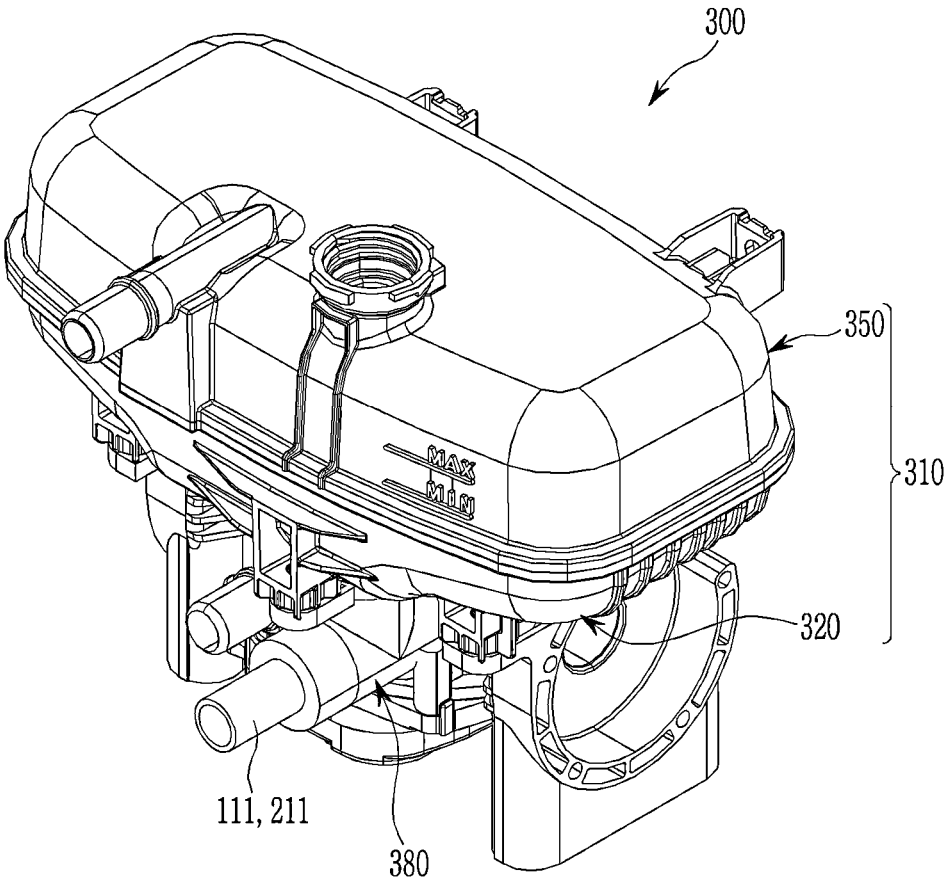
FIG. 2 is a perspective view illustrating a configuration of a reservoir tank assembly according to the present disclosure.
Figure 3:
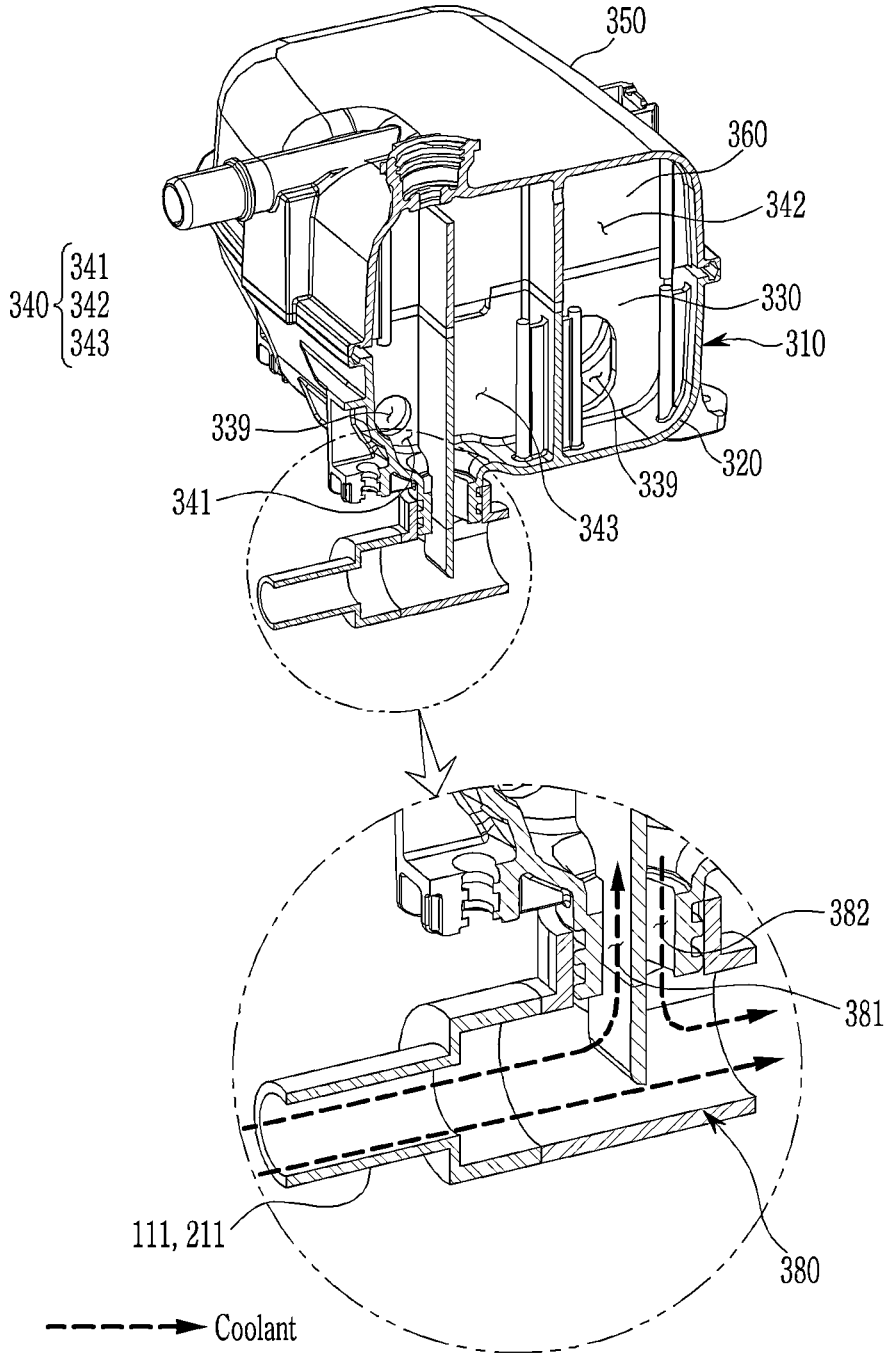
FIG. 3 is a partial cross-sectional perspective view illustrating a configuration of a reservoir tank assembly according to the present disclosure.
Figure 4:
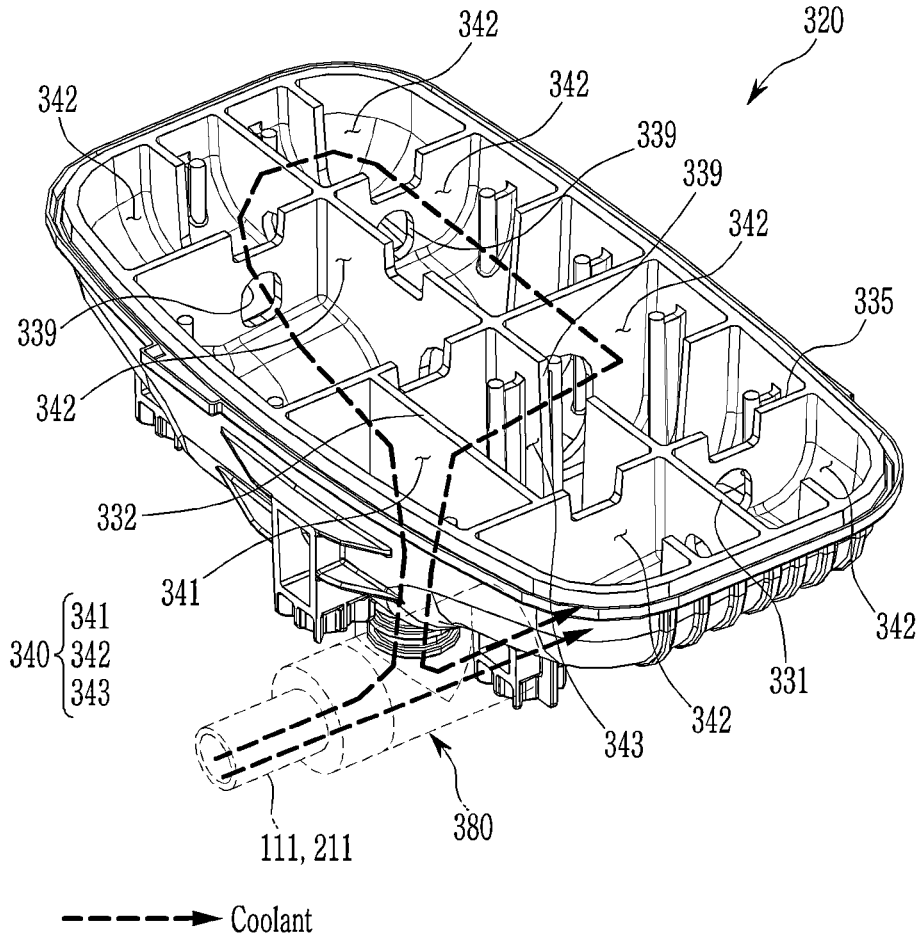
FIG. 4 is a perspective view illustrating a configuration of a reservoir tank assembly excluding an upper casing according to the present disclosure.
Figure 5:
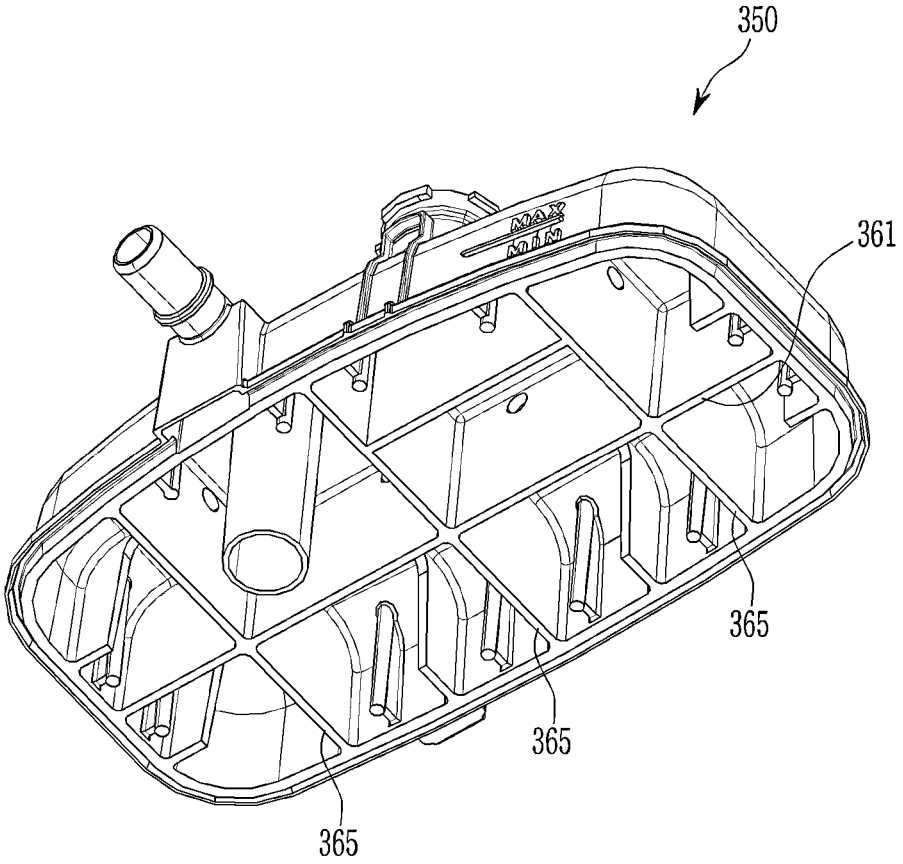
FIG. 5 is a perspective view illustrating a configuration of an upper casing according to the present disclosure.

FIG. 2 is a perspective view illustrating a configuration of the reservoir tank assembly according to the present disclosure. FIG. 3 is a partial cross-sectional perspective view illustrating a configuration of one example of the reservoir tank assembly according to the present disclosure. FIG. 4 is a perspective view illustrating a configuration of one example of the reservoir tank assembly excluding an upper casing according to the present disclosure. Further, FIG. 5 is a perspective view illustrating a configuration of one example of the upper casing according to the present disclosure.

With reference to FIGS. 2-5, the reservoir tank assembly 300 is disposed in parallel with the coolant line (the first coolant line 111 and/or the second coolant line 211). That is to say, a part of the coolant flowing through the coolant line passes through the reservoir tank assembly 300 and then is introduced into the coolant line. The remaining coolant flows along the coolant line without passing through the reservoir tank assembly 300.

The reservoir tank assembly 300 may include a housing 310 having a plurality of spaces (a plurality of degassing chambers) configured to store the coolant and may include an adapter 380 configured to fluidly connect the housing 310 and the coolant line. A part of the coolant flowing through the coolant line is introduced into any one degassing chamber 340, among the plurality of degassing chambers 340, through the adapter 380. The coolant passing through the plurality of degassing chambers 340 may be discharged to the coolant line through the adapter 380.

The adapter 380 has a coolant inlet 381 through which a part of the coolant flowing along the coolant line is introduced. The adapter 380 also has a coolant outlet 382 through which the coolant passing through the plurality of degassing chambers 340 is discharged. The coolant inlet 381 may be fluidly connected to any one degassing chamber 340 among the plurality of degassing chambers 340. The coolant outlet 382 may be fluidly connected to another degassing chamber 340 among the plurality of degassing chambers 340.

The plurality of degassing chambers 340 may be formed in the housing 310 and may be configured to remove air contained in the coolant. The housing 310 may include a lower casing 320 and an upper casing 350 provided above the lower casing 320. The lower casing 320 and the upper casing 350 collectively define the space (i.e., the plurality of degassing chambers) for storing the coolant.

The lower casing 320 may be formed in an approximately hexahedral shape having a hollow portion therein and opened at an upper side thereof. The upper casing 350 may be formed in an approximately hexahedral shape having a hollow portion therein and opened at a lower side thereof.

The lower casing 320 has a plurality of lower partition walls 330, and the upper casing 350 has upper partition walls 360 corresponding to the lower partition walls 330. The lower partition walls 330 and the upper partition walls 360 collectively define the plurality of degassing chambers 340 when the housing 310 is assembled.

The lower partition walls 330 formed in the lower casing 320 may include at least one lower lengthwise partition wall 331 and at least one lower widthwise partition wall 335. The lower partition wall 331 and the lower partition wall 335 may be disposed to be orthogonal to each other. Depending on the use position and the shape and/or size of the reservoir tank assembly 300, these walls may be referred to as horizontal and vertical walls, transverse and longitudinal walls, walls formed in a grid pattern, lengthwise and widthwise walls, etc.

The lower partition wall or walls 331 may be formed to be elongated in a vertical, lengthwise, or longitudinal direction of the lower casing 320. In this example, there is one central lower partition wall 331 arranged in the vertical, lengthwise, or longitudinal direction. The lower partition wall or walls 335 may be disposed to be perpendicular to the lower partition wall(s) 331 and thus may be formed to be in a horizontal, widthwise, or transverse direction. The lower partition walls 331 and 335 may each be provided as a plurality of such lower partition walls 331 and 335 formed sequentially. In this example, there are three lower partition walls 335 arranged in the horizontal, widthwise, or transverse direction. As necessary, auxiliary lower partition walls 332 may be formed between the lower partition walls 335 and arranged parallel with the one lower partition wall 331 in this example.

Further, the upper partition walls 360 formed in the upper casing 350 may include an upper partition wall 361 corresponding to the lower partition wall 331 arranged in the vertical, lengthwise, or longitudinal direction. The upper partition walls 360 may also include upper partition walls 365 corresponding to the lower partition walls 335 and arranged in the horizontal, widthwise, or transverse direction. That is to say, one upper vertical partition wall 361 may be formed to be elongated in the vertical, lengthwise, or longitudinal direction of the upper casing 350. The upper partition walls 365 may be disposed to be perpendicular to the upper partition wall 361 and may include a first upper partition wall 365, a second upper partition wall 365, and a third upper partition wall 365 formed sequentially and corresponding to the three lower partition walls 335 arranged in the horizontal, widthwise, or transverse direction. As necessary, auxiliary upper partition walls may be formed between the first and second upper partition walls 365 to correspond with the auxiliary lower partition walls noted above.

The plurality of degassing chambers 340 is defined by the lower partition wall 331 and the lower partition walls 335 formed in the lower casing 320 and the upper partition wall 361 and the upper partition walls 365 formed in the upper casing 350. In the present disclosure, the degassing chambers 340 may include an inlet chamber 341, an outlet chamber 343, and at least one intermediate chamber 342 through which the coolant introduced through the inlet chamber 341 passes. In the present disclosure, seven intermediate chambers 342 may be formed. The number of degassing chambers may vary and depend on the number of the various upper and lower partition walls.

Degassing holes 339 are formed at preset positions in the lower partition wall 331 and the lower partition walls 335 of the lower partition walls 330. In the present disclosure, the degassing holes 339 are formed at preset positions in the lower partition walls 335 and the lower partition wall 331 between the intermediate chambers 342.

A direction (or a flow distance of the coolant) in which the coolant flows in the reservoir tank assembly 300 is determined depending on the positions of the degassing holes 339. In the present disclosure, the positions of the degassing holes 339 may be formed to maximize the flow distance of the coolant in the reservoir tank assembly 300. As described above, the air contained in the coolant may be easily removed as the flow distance of the coolant in the reservoir tank assembly 300 increases.

Hereinafter, a flow of the coolant made by the reservoir tank assembly 300 according to the present disclosure is described.

A part of the coolant flowing along the coolant line is introduced into the inlet chamber 341 through the coolant inlet 381 of the adapter 380 of the reservoir tank assembly 300. The coolant introduced into the inlet chamber 341 passes through at least one intermediate chamber 342 and then is introduced into the outlet chamber 343. The coolant introduced into the outlet chamber 343 is introduced into the coolant line through the coolant outlet 382 of the adapter 380. During the process in which the coolant passes through the plurality of degassing chambers 340 in the reservoir tank assembly 300, a flow velocity of the coolant decreases and a turbulent flow intensity of the coolant decreases. When the flow velocity and the turbulent flow intensity of the coolant decrease as described above, the air contained in the coolant is discharged from the coolant.

Further, the remaining coolant flowing along the coolant line flows along the coolant line without passing through the reservoir tank assembly 300.

As described above, the reservoir tank assembly 300 disposed in parallel with the coolant line may smoothly remove the air contained in the coolant. This may increase the specific heat of the coolant circulating through the entire heat pump system and improve the cooling performance.

In addition, the coolant from which the air is removed is introduced into the water pump. This may improve noise, vibration, and harshness (NVH) performance of the water pump.

In addition, the reservoir tank assembly 300 is disposed in parallel with the coolant line and removes the air contained in the coolant. This may minimize a volume of the degassing chamber 340 of the reservoir tank assembly 300, thereby implementing better vehicle packaging.

Figure 6:
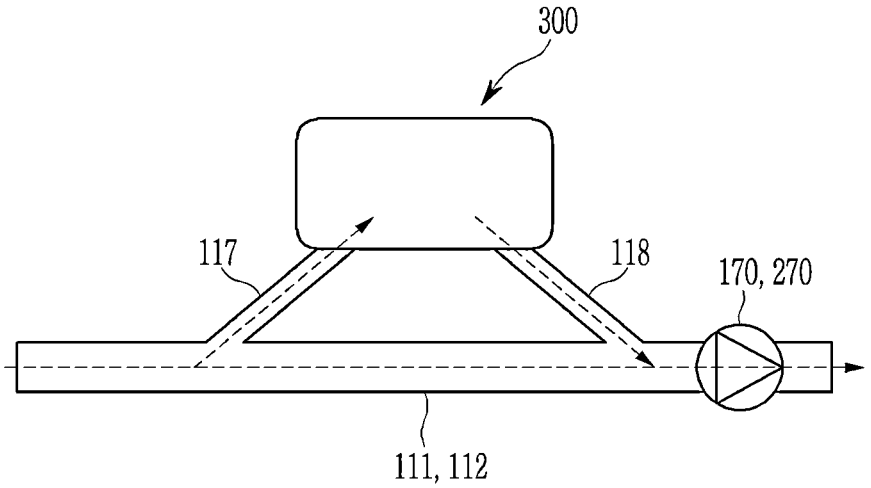
FIG. 6 is a conceptual view illustrating a configuration in which a reservoir tank assembly according to another example of the present disclosure is connected to a coolant line.

FIG. 6 is a conceptual view illustrating a configuration in which a reservoir tank assembly 300 according to another example of the present disclosure is applied to the coolant line. Further, FIG. 7 is a perspective view illustrating a configuration of a reservoir tank assembly 300 according to another example of the present disclosure.

Figure 7:
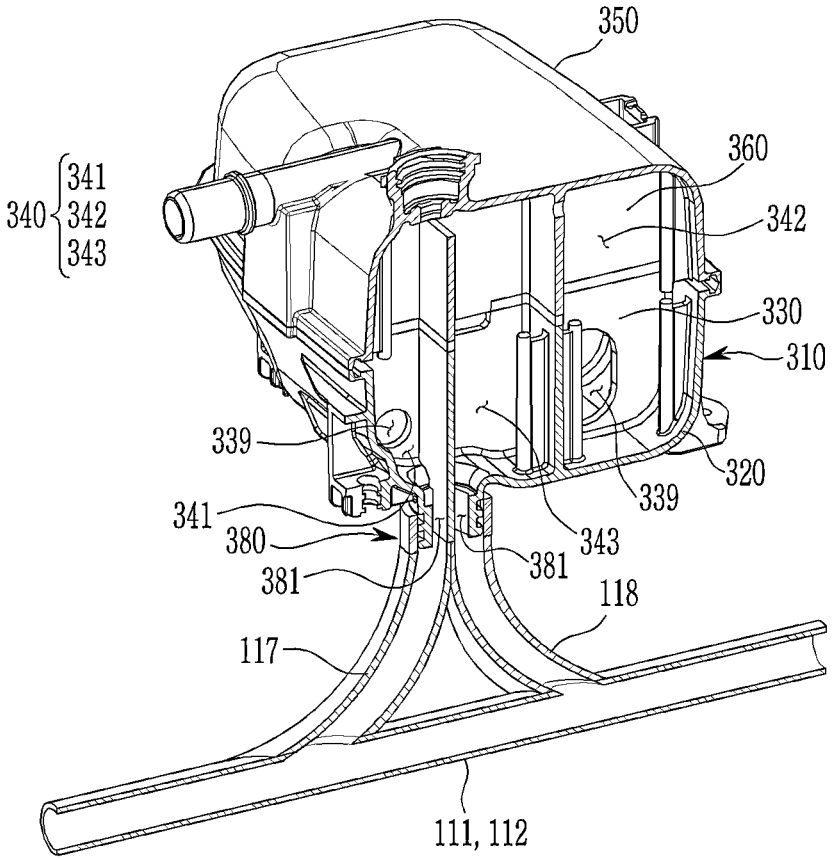
FIG. 7 is a perspective view illustrating a configuration of a reservoir tank assembly according to another example of the present disclosure.

With reference to FIGS. 6 and 7, the reservoir tank assembly 300 is disposed in parallel with the coolant line (the first coolant line 111 and/or the second coolant line 211). Hereinafter, because the remaining configurations and operating processes of the reservoir tank assembly 300 illustrated in FIGS. 6 and 7 are identical to the configurations and operating processes of the reservoir tank assembly 300 described with reference to FIGS. 2-5, a detailed description thereof has been omitted.

The reservoir tank assembly 300 according to another example of the present disclosure may include the reservoir tank 300 including the housing 310 having the plurality of degassing chambers 340. The reservoir tank assembly 300 may also include an adapter 380 configured to fluidly connect any one degassing chamber 340 among the plurality of degassing chambers 340 of the reservoir tank 300 and a first bypass line 117 branching off from the coolant line and to fluidly connect another degassing chamber 340 among the plurality of degassing chambers 340 of the reservoir tank 300 and a second bypass line 118 branching off from the coolant line at a downstream side of the first bypass line 117.

The adapter 380 may include the coolant inlet 381 fluidly connected to the first bypass line 117, which branches off from the coolant line and which is fluidly connected to any one degassing chamber 340 among the plurality of degassing chambers 340 of the reservoir tank 300. The adapter 380 may also include the coolant outlet 382 fluidly connected to the second bypass line 118, which branches off from the coolant line at the downstream side of the first bypass line 117 and which is configured to communicate with another degassing chamber 340 among the plurality of degassing chambers 340.

A part of the coolant flowing along the coolant line is introduced into the coolant inlet 381 of the adapter 380 through the first bypass line 117. The coolant, which is introduced into the reservoir tank 300 through the adapter 380 and passes through the plurality of degassing chambers 340 (e.g., the inlet chamber 341, at least one intermediate chamber 342, and the outlet chamber 343), is discharged to the coolant outlet 382 of the adapter 380 and introduced into the coolant line through the second bypass line 118.

Further, the remaining coolant flowing along the coolant line flows along the coolant line without passing through the bypass lines 117 and 118 and the reservoir tank assembly 300.

While the embodiments of the present disclosure have been described above, the present disclosure is not limited thereto. Various modifications can be made and carried out within the scope of the claims, the detailed description of the disclosure, and the accompanying drawings, and also fall within the scope of the disclosure.

DESCRIPTION OF SYMBOLS

100: First cooling circuit
111: First coolant line
112: First branch line
113: First valve
117: First bypass line
118: Second bypass line
120: First radiator
130: Cooling fan
140: Electrical component
170: First water pump
200: Second cooling circuit
211: Second coolant line
212: Second branch line
213: Third branch line
214: Second valve
220: Second radiator
230: Battery module
240: Battery heater
250: Battery chiller
260: Water-cooled heat exchanger
270: Second water pump
300: Reservoir tank

310: Housing
320: Lower casing
330: Lower partition wall—general
331: Lower partition wall—vertical, lengthwise, longitudinal
332: Auxiliary lower partition wall—vertical, lengthwise, longitudinal
335: Lower partition wall—horizontal, widthwise, transverse
339: Degassing hole
340: Degassing chamber
341: Inlet chamber
342: Intermediate chamber
343: Outlet chamber
350: Upper casing
360: Upper partition —general
361: Upper partition wall—vertical, lengthwise, longitudinal
365: Upper partition wall—horizontal, widthwise, transverse
380: Adapter
381: Coolant inlet
382: Coolant outlet

What is claimed is:

1. A reservoir tank assembly comprising:
a reservoir tank configured to remove air contained in a coolant; and
an adapter fluidly connecting the reservoir tank and a coolant line along which the coolant flows,
wherein a part of the coolant flowing along the coolant line is introduced into any one degassing chamber among a plurality of degassing chambers through the adapter,
wherein the coolant passing through the plurality of degassing chambers is discharged to the coolant line through the adapter,
wherein the reservoir tank has a housing including the plurality of degassing chambers, and
wherein the reservoir tank is integrated with a water pump.

2. The reservoir tank assembly of claim 1, wherein the adapter comprises:
a coolant inlet through which a part of the coolant flowing along the coolant line is introduced, wherein the coolant inlet is configured to communicate with any one degassing chamber among the plurality of degassing chambers; and
a coolant outlet through which the coolant passing through the plurality of degassing chambers is discharged, wherein the coolant outlet is configured to communicate with another degassing chamber among the plurality of degassing chambers.

3. The reservoir tank assembly of claim 2, wherein the housing comprises:
a lower casing having a plurality of lower partition walls; and
an upper casing provided above the lower casing and having upper partition walls corresponding to the plurality of lower partition walls,
wherein the plurality of lower partition walls and the upper partition walls collectively define the plurality of degassing chambers to remove air contained in the coolant.

4. The reservoir tank assembly of claim 3, wherein degassing holes are formed in the plurality of lower partition walls.

5. The reservoir tank assembly of claim 4, wherein the degassing holes are positioned to maximize a flow distance of the coolant.

6. The reservoir tank assembly of claim 1, wherein the adapter comprises:
a coolant inlet fluidly connected to a first bypass line, which branches off from the coolant line and is configured to communicate with any one degassing chamber among the plurality of degassing chambers; and
a coolant outlet fluidly connected to a second bypass line, which branches off from the coolant line at a downstream side of the first bypass line and is configured to communicate with another degassing chamber among the plurality of degassing chambers, wherein the coolant outlet is configured to allow the coolant having passed through the plurality of degassing chambers to be discharged through the coolant outlet.

7. The reservoir tank assembly of claim 6, wherein the housing comprises:
a lower casing having a plurality of lower partition walls; and
an upper casing provided above the lower casing and having upper partition walls corresponding to the plurality of lower partition walls,
wherein the plurality of lower partition walls and the upper partition walls collectively define the plurality of degassing chambers.

8. The reservoir tank assembly of claim 7, wherein degassing holes are formed in the plurality of lower partition walls.

9. The reservoir tank assembly of claim 8, wherein the degassing holes are positioned to maximize a flow distance of the coolant.

10. A heat pump system comprising:
a coolant line along which a coolant flows;
a reservoir tank configured to remove air contained in the coolant; and
an adapter configured to fluidly connect the reservoir tank and the coolant line,
wherein a part of the coolant flowing along the coolant line is introduced into any one degassing chamber among a plurality of degassing chambers through the adapter,
wherein the coolant passing through the plurality of degassing chambers is discharged to the coolant line through the adapter,
wherein the reservoir tank has a housing including the plurality of degassing chambers, and
wherein the reservoir tank is integrated with a water pump.

11. The heat pump system of claim 10, wherein the adapter comprises:
a coolant inlet through which a part of the coolant flowing along the coolant line is introduced into the housing; and
a coolant outlet through which the coolant passing through the plurality of degassing chambers is discharged.

12. The heat pump system of claim 10, wherein the housing comprises:
a lower casing having a plurality of lower partition walls; and
an upper casing provided above the lower casing and having upper partition walls corresponding to the plurality of lower partition walls, wherein the plurality of lower partition walls and the upper partition walls collectively define the plurality of degassing chambers to remove air contained in the coolant.

13. The heat pump system of claim 12, wherein degassing holes are formed in the plurality of lower partition walls.

14. The heat pump system of claim 13, wherein the degassing holes are positioned to maximize a flow distance of the coolant.

15. The heat pump system of claim 10, further comprising:

a first bypass line branching off from the coolant line; and a second bypass line branching off from the coolant line at a downstream side of the first bypass line, wherein the coolant inlet of the adapter is fluidly connected to the first bypass line, and wherein the coolant outlet of the adapter is fluidly connected to the second bypass line.

16. The heat pump system of claim 15, wherein the housing comprises:

a lower casing having a plurality of lower partition walls; and an upper casing provided above the lower casing and having upper partition walls corresponding to the plurality of lower partition walls, wherein the plurality of lower partition walls and the upper partition walls collectively define the plurality of degassing chambers.

17. The heat pump system of claim 16, wherein degassing holes are formed in the plurality of lower partition walls.

18. The heat pump system of claim 17, wherein the degassing holes are positioned to maximize a flow distance of the coolant.

* * * * *